US006554587B2

(12) United States Patent
Paolini et al.

(10) Patent No.: US 6,554,587 B2
(45) Date of Patent: Apr. 29, 2003

(54) PUMP AND DIAPHRAGM FOR USE THEREIN

(75) Inventors: Louis J. Paolini, Corona, CA (US); Joseph A. Pascual, Lake Forest, CA (US); Jonathan Dinh, Orange, CA (US)

(73) Assignee: SHURflo Pump Manufacturing Company, Inc., Cypress, CA (US)

( * ) Notice: Subject to any disclaimer, the term of this patent is extended or adjusted under 35 U.S.C. 154(b) by 0 days.

(21) Appl. No.: 09/993,395

(22) Filed: Nov. 16, 2001

(65) Prior Publication Data

US 2002/0094285 A1 Jul. 18, 2002

Related U.S. Application Data

(60) Provisional application No. 60/249,314, filed on Nov. 16, 2000.

(51) Int. Cl.[7] ..... F04B 17/00; F01B 19/00

(52) U.S. Cl. ..... 417/413.1; 417/412; 92/96; 92/129; 92/99

(58) Field of Search ..... 417/413.1, 412; 92/96, 129, 99

(56) References Cited

U.S. PATENT DOCUMENTS

| | | | | | |
|---|---|---|---|---|---|
| 878,260 | A | | 2/1908 | Watson | 417/44.8 |
| 1,804,375 | A | | 5/1931 | Cobe | 417/418 |
| 2,152,241 | A | | 3/1939 | Coons | 417/413.1 |
| 2,630,760 | A | | 3/1953 | Ryba | 417/413.1 |
| 2,654,324 | A | | 10/1953 | Ryba | 417/413.1 |
| 2,659,310 | A | | 11/1953 | Ryba | 417/413.1 |
| 2,930,324 | A | | 3/1960 | Toulmin, Jr. | 417/413.1 |
| 3,202,886 | A | | 8/1965 | Kramer | 335/234 |
| 3,273,584 | A | | 9/1966 | Kennepohl | 417/413.1 |
| 3,884,125 | A | | 5/1975 | Massie | 417/418 |
| 4,058,888 | A | * | 11/1977 | Tomczak et al. | 29/593 |
| 4,224,860 | A | * | 9/1980 | Neighbor et al. | 92/100 |
| 4,235,153 | A | | 11/1980 | Rinde et al. | 310/14 |
| 4,272,226 | A | | 6/1981 | Osborne | 417/418 |
| 4,278,406 | A | | 7/1981 | Cooperrider | 417/413.1 |
| 4,370,107 | A | * | 1/1983 | Landis et al. | 417/413.1 |
| 4,468,177 | A | | 8/1984 | Strimling | 417/413.1 |
| 4,533,890 | A | | 8/1985 | Patel | 310/14 |
| 4,558,293 | A | | 12/1985 | Haneda | 335/255 |
| 4,721,440 | A | | 1/1988 | Hurst | 417/371 |
| 4,786,240 | A | | 11/1988 | Koroly et al. | 417/413.1 |
| 4,832,582 | A | * | 5/1989 | Buffet | 417/413.1 |
| 5,012,144 | A | | 4/1991 | Huitema et al. | 310/14 |
| 5,309,050 | A | | 5/1994 | Morinigo et al. | 310/14 |
| 5,341,054 | A | | 8/1994 | Tal et al. | 310/14 |
| 5,362,213 | A | | 11/1994 | Komatsu et al. | 417/418 |
| 5,438,227 | A | | 8/1995 | Satomi | 310/314 |
| 5,687,633 | A | * | 11/1997 | Eady | 92/99 |
| 6,142,062 | A | * | 11/2000 | Streitman | 92/103 F |
| 6,145,430 | A | * | 11/2000 | Able et al. | 92/100 |

FOREIGN PATENT DOCUMENTS

| | | |
|---|---|---|
| DE | 3102032 | 8/1982 |
| FR | 1380313 | 10/1964 |
| SU | 1041747 | 9/1983 |
| SU | 1610067 | 11/1990 |

* cited by examiner

*Primary Examiner*—Charles G. Freay
*Assistant Examiner*—Michael K. Gray
(74) *Attorney, Agent, or Firm*—Michael Best & Friedrich LLP

(57) ABSTRACT

The pump of the present invention preferably includes a housing having an inlet port, an outlet port and a chamber located in fluid communication with the inlet port and the outlet port. A diaphragm is sealingly secured in the chamber and, together with the housing, define a fluid passageway from the inlet port to the outlet port. An electromagnetic assembly or other driving device is preferably secured to the housing and is positioned to move the diaphragm in order to pump fluid through the pump. In some preferred embodiments, the electromagnetic assembly includes a plunger positioned and adapted to move the diaphragm against the biasing force of a spring. Improved diaphragms and diaphragm features are also disclosed, including a two-part diaphragm structure, diaphragm sealing portions for sealing the fluid chamber from driving and biasing assemblies of the pump, and inherently biased diaphragms.

45 Claims, 5 Drawing Sheets

PUMP AND DIAPHRAGM FOR USE THEREIN

This application claims the benefit of Provisional Application No. 60/249,314, filed Nov. 16, 2000.

FIELD OF THE INVENTION

The present invention relates to pumps, and more generally to diaphragm pumps and diaphragms used in such pumps.

BACKGROUND OF THE INVENTION

Diaphragm pumps that are driven by an electromagnetic device are well known to those skilled in the art. Diaphragm pumps are often not optimized for certain applications. For example, diaphragm pumps are often single acting (i.e., the working piston or diaphragm of the pump effectively pumps fluid only during a portion of its movement). As another example, diaphragm pumps are designed for pumping only one fluid at a time, despite the fact that it may often be desirable to pump two fluids simultaneously or closely in time. The rapid cycling of the drive mechanisms of such pumps can produce significant operation noise. Further, effectively sealing the electromagnetic or other drive mechanisms from the fluid being pumped is often essential to maintaining safe and effective pump operation, but can be difficult and costly and can adversely impact pump life.

It would be advantageous to provide an electromagnetically driven pump that addresses one or more of these concerns.

SUMMARY OF THE INVENTION

A number of pump embodiments according to the present invention are advantageously dual or double acting, thereby increasing pumping capacity. In addition, some of the pumps of the present invention reduce noise during operation. In some embodiments, the pumps of the present invention have self-priming capabilities. In certain embodiments, the pumps do not rely upon the fluid being pumped for lubrication, can be "run dry" for relatively long periods without incurring damage or without incurring significant damage. The diaphragms of the present invention are preferably configured to effectively seal the fluid being pumped from the electromagnetic drive assemblies, and in some embodiments can instead or in addition function to separate one fluid path through the pump from another. Many of the pumps and pump diaphragms according to the present invention are significantly more efficient, quiet, compact, have relatively long lives, and can be manufactured and assembled at relatively low cost.

In some preferred embodiments of the present invention, the pump includes a housing, a diaphragm, and an electromagnetic assembly. The pump housing has an inlet port, an outlet port, and a chamber in fluid communication with the inlet port and outlet port. As described in greater detail below, such pumps are capable of extended operation, can operate very effectively at high pressures, and have self-priming capabilities.

The diaphragm is preferably sealingly secured in the chamber and extends in at least one direction (and more preferably in both directions) to a sealed relationship with the housing. Some embodiments of the diaphragm have a central portion, a peripheral portion, and first and second projections. The central portion is adapted for movement relative to a housing of the pump to pump a fluid through the housing. The peripheral portion is preferably joined to the central portion and is adapted to be sealingly secured to the housing of the pump. The first and second projections (if employed) preferably extend generally axially outwardly from the central portion. Each of the first and second projections can include a sealing region that is adapted to be secured to the pump housing.

Although a number of different diaphragm shapes are possible, the diaphragm preferably has a central axis generally circumscribed by the peripheral portion. The first and second projections (if employed) preferably also circumscribe the central axis, and can be tubular structures or can have other shapes as desired.

Preferably, the diaphragm extends axially in either or both directions into apertures shaped to receive the axially-extending parts of the diaphragm. The diaphragm is preferably sealingly secured within first and second apertures located on respective axial sides of the diaphragm, and cooperates with the housing to define a fluid passageway between the inlet port and the outlet port. Specifically, some preferred diaphragm embodiments of the present invention include first and second seal portions configured to fluidly isolate the first and second apertures, respectively, from the fluid passageway between the inlet and outlet ports. The first and second seal portions extend axially away from each other and are preferably secured to the housing.

In some embodiments, the diaphragm includes an inner element or central portion that is more rigid than an outer portion of the diaphragm substantially surrounding the inner element. Force is preferably exerted by the plunger and a biasing assembly (described below) against the relatively rigid inner element of the diaphragm. For example, the relatively rigid inner element can be contacted and pushed or pulled by the plunger and the bias assembly, which lends sufficient strength and rigidity to the diaphragm such that the diaphragm can provide effective pumping action to pump fluid through the chamber. The relatively flexible outer portion of the diaphragm preferably allows the diaphragm to be sealingly secured to the housing while allowing oscillation of the diaphragm within the chamber to provide the desired pumping action. Preferably, the outer portion includes a radially extending peripheral zone that is sealingly secured to the housing. The diaphragm preferably has sufficient flexibility to deflect in response to movement of the plunger and the bias assembly without compromising the seals between the diaphragm and the housing.

Any of the diaphragms of the present invention can be structured such that when they are in a relaxed state, they are either substantially neutral or substantially biased in one direction. Thus, in some embodiments, the diaphragm is structured to be neutral when there are substantially no external forces applied thereto. In this respect, the diaphragm can be configured such that the central portion is spaced an equal distance from axially extending distal ends of the first and second projections of the diaphragm, although other relationships between such a central portion and distal ends is possible. In any case, this "neutral" type of diaphragm can be configured so that the central portion is substantially centrally located in the chamber when the pump is non-operative. In other embodiments, the present diaphragm is structured to be biased toward one end of the housing when there are substantially no external forces applied to the diaphragm. In other words, the diaphragm is configured to be biased toward one of the discharge position and the intake position of the pump. In this respect, the diaphragm can be configured such that the central portion is positioned closer to the distal end of the first projection relative to the distal end of the second projection. Such biasing of the diaphragm can provide enhanced pumping efficiency relative to a similar pump with a neutral diaphragm. For example, a diaphragm biased toward the intake position is effective in assisting a bias assembly (described in greater detail below) in returning the diaphragm to the intake position so that fluid flows efficiently into the fluid chamber. The diaphragm can be made of any suitable material effective to provide a diaphragm that functions as described herein. In some embodiments, the diaphragm is made of at least one polymeric material.

The diaphragm of the present invention is movable between a discharge position in which fluid in the fluid chamber is discharged to an cutlet port of the pump, and an intake position, in which fluid is passed from an inlet port of the pump into the fluid chamber.

In some embodiments of the present invention, the pump includes an inlet valve assembly positioned generally upstream of the chamber and adapted to control fluid flow between the inlet port and the fluid passageway. The pump can also include an outlet valve assembly positioned generally downstream of the chamber and adapted to control fluid flow between the fluid passageway and the outlet port. Also, some pumps according to the present invention have first and second inlet valve assemblies and first and second outlet valve assemblies. Each pair of inlet and outlet valve assemblies is preferably positioned in independent fluid passageways that are partially defined by opposing sides of the diaphragm. Thus, with the peripheral portion of the diaphragm sealingly secured to the housing, two isolated fluid passageways are provided in the chamber. One fluid passageway can be defined by one side of the diaphragm and at least one chamber wall, while the other fluid passageway can be defined by an opposite side of the diaphragm and at least one other chamber wall. In such embodiments, each fluid passageway can have different inlet and outlet valve assemblies.

Any suitable valve assembly may be employed as an inlet or outlet valve assembly in the present pumps. In some embodiments, each of the inlet and outlet valve assemblies comprises a valve chamber, a valve seat, a valve element (for example, in the shape of a partial sphere or ball) and a spring positioned to urge the valve element against the valve seat. Such biased valve assemblies are very effective in controlling positive flow through the pump while acting as check valves to substantially prevent unwanted back flow in the pump. Examples of valves that can be employed in the inlet and outlet valve assemblies of the present invention include flapper valves, leaf valves, snapper valves, ball valves, check valves (such as spring loaded check valves) and the like, many of which are of conventional and/or well known design and construction.

The electromagnetic assembly of the above-described embodiments can be secured to the housing and can include a plunger. Preferably, the plunger is configured to move to cause the diaphragm to move, thereby pumping fluid from the inlet port toward the outlet port. More specifically, the plunger is configured to move the diaphragm to at least one of the discharge position and the intake position.

In some embodiments, a bias assembly is positioned on an opposite side of the diaphragm and is adapted to urge the diaphragm to move toward the plunger. The bias assembly is preferably positioned to substantially oppose the electromagnetic assembly, to facilitate movement of the diaphragm toward at least one of the intake position and the discharge position, and preferably to contact both the housing and the diaphragm.

The bias assembly can take a number of different forms, and in some preferred embodiments includes a spring. The spring can cooperate with the electromagnetic assembly to impart reciprocal movement to the diaphragm. This combination of a bias assembly and an electromagnetic assembly can provide effective pumping action at relatively reduced cost compared to dual electromagnetic assembly pumps described elsewhere herein.

In some embodiments, a bias assembly can be located on the same side of the diaphragm as the plunger, and can have a biasing element (e.g., a spring) applying a biasing force to the plunger, urging the plunger toward the diaphragm. Such a bias assembly can be used in place of or in addition to the bias assembly described above to exert force upon the diaphragm. In some embodiments, this bias assembly can be connected to a rod configured to contact the diaphragm and to be moveable between a first position that corresponds to the discharge position of the diaphragm, and a second position that corresponds to the intake position of the diaphragm. The rod preferably is substantially freely moveable between the first position and the second position. One or more seals such as O-ring seals are preferably provided and are positioned about the rod. These seals are adapted to prevent the passage of fluid from the fluid chamber to other areas of the pump.

Either type of bias assembly described above can be located inside or outside of an aperture within which an extension of the diaphragm is received (as described above). The spring or other bias element used to exert the forces described above can also be (and preferably is) located outside of the chamber in which the diaphragm is located.

It may be desirable in some applications to adjust the amount of force exerted upon the plunger or upon the diaphragm by a bias assembly. In such cases, any of the bias assemblies described above can adjustable. Adjustment of the bias assemblies can be provided using any suitable structure. In some embodiments, a bias-adjusting member in the form of a nut threaded onto a threaded rod (such as the rod described above) connected to the plunger is provided. In such embodiments, the biasing member can be located between the nut and the end of the plunger. The threaded rod can be passed through the plunger (which is hollow in some embodiments) and into a center opening in the diaphragm. In this regard, the biasing force applied to the diaphragm and plunger can urge the diaphragm and plunger together, and can be adjusted by manipulation of the axial position of the nut on the threaded rod.

Some preferred embodiments of the present invention have electronic circuitry in electrical communication with an electromagnetic assembly driving the pump. This circuitry is configured to provide electrical energy to the electromagnetic assembly so as to cause the diaphragm to move, thereby moving the diaphragm between the intake position and the discharge position to pump fluid from the inlet port toward the outlet port. The electronic circuitry may be of conventional design effective to control the electromagnetic assembly so that the electromagnetic assembly and bias assembly cooperate to move the diaphragm in a substantially coordinated manner. Of course, other forms of electronic circuitry can instead be employed provided that such other forms function as described herein.

The electromagnetic assembly preferably includes a core that may, for example, be magnetic. Although a core is not required, a core is preferred for superior plunger control and power. The plunger of the electromagnetic assembly is preferably moveable relative to the core of the electromagnetic assembly. In some embodiments, such movement is controlled so that the plunger does not contact the core. Specifically, the electronic circuitry may be adapted to prevent contact between the plunger and the core. In these and other embodiments, the plunger can be sized and positioned so that the plunger is incapable of contacting the core. For example, the electromagnetic assembly can be sized so that the stroke or travel distance of the plunger is such that the plunger cannot contact the core at any point along the stroke of the plunger. Alternatively or in addition, the housing and/or the fluid in the fluid passageway can limit the movement of the diaphragm so that the stroke of the plunger is also limited, thereby limiting or preventing contact between the plunger and the core.

Preventing contact between the plunger and the core (when used) enhances the efficiency of the present pumps by avoiding the formation of a full or complete magnetic circuit between the plunger and the core. Were a full magnetic circuit to form, additional force or power could be required to separate the plunger and the core. In addition, by preventing the plunger from contacting the core, noise that would typically be associated with repeated contact between the plunger and the core is avoided. This reduces the overall noise level of the pump and can advantageously provide a more effective and efficient pump.

The plunger may be allowed to move solely in response to the electromagnetic forces being applied thereto. However, in one advantageous embodiment, the plunger is biased toward the diaphragm so as to be in substantially continuous contact with the diaphragm. Such substantially continuous contact prevents the development of a separation or a gap between the plunger and the diaphragm during operation. In some embodiments, the diaphragm is connected to the plunger by one or more fasteners, such as a screw or similar member inserted through the diaphragm (e.g., through the central portion of the diaphragm) and into the plunger, thereby maintaining the plunger in continuous contact with the diaphragm. Such biasing or substantially continuous plunger/diaphragm contact may be provided in any suitable way provided that the pumping action developed by the pump is not excessively adversely affected. Such biasing can significantly enhance the efficiency of the pump relative to a pump in which the plunger is not biased to remain in substantially continuous contact with the diaphragm. In some embodiments, such biasing forces the plunger against the diaphragm to creates a semi-rigid connection between the plunger, the diaphragm and the biasing assembly. The semi-rigid connection between the plunger, the diaphragm and the biasing assembly is preferred because the semi-rigid connection provides additional tolerance for minor imbalances of pump load as well as for variations in coordination between the electromagnetic assembly and the biasing assembly.

The various embodiments of pumps according to the present invention preferably employ an electromagnetic assembly for moving a plunger and diaphragm to pump fluid through the pump. However, it should be noted that other types of driving devices can instead be employed to move the diaphragm as described herein (whether through a plunger or otherwise). By way of example only, the electromagnetic assembly described above can be replaced by a hydraulic or pneumatic piston, a motor (driving the diaphragm through, for example, a cam connected to the motor and contacting the diaphragm or plunger), an electromagnet set connected to the diaphragm or plunger and to another surface adjacent to the diaphragm or plunger, and the like. Still other driving devices anti actuators are possible, each one of which can be controlled with the electronic circuitry described above to drive the diaphragm and to pump fluid through the pump.

Although the pumps according to the present invention are useful for pumping a single fluid, in some embodiments the pumps are adapted to pump two or more different fluids. As such, the present pumps can include a plurality of fluid passageways. Thus, although the same fluid can be used to pass through each of the different passageways alternatively, different fluids can be pumped through different passageways. In some embodiments for example, the pump includes two inlet ports and two outlet ports, while the diaphragm and the housing together define two mutually isolated fluid passageways. Different fluids can be pumped between each inlet port/outlet port pair and through each isolated fluid passageway.

The present pumps can be employed to pump fluids, such as liquids, at relatively low flow rates (although relatively high flow rate pumps according to the present invention are possible). For example, flow rates of about 0.5 liters/hr to about 100 liters/hr or more are common. Examples of useful applications include, without limitation, pumping floor cleaning chemicals for dispensing; plumping water to beverage dispensers; pumping comestible fluid; various automotive and vehicular applications, such as pumping a urea solution for a diesel emission control system; medical applications, and the like.

Each and every feature described herein, and each and every combination of two or more of such features, is included within the scope of the present invention provided that the features included in such a combination are not mutually inconsistent.

These and other aspects and advantages of the present invention are apparent in the following detailed description and claims, particularly when considered in conjunction with the accompanying drawings in which like parts bear like reference numerals.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE DRAWINGS

Figure 1:
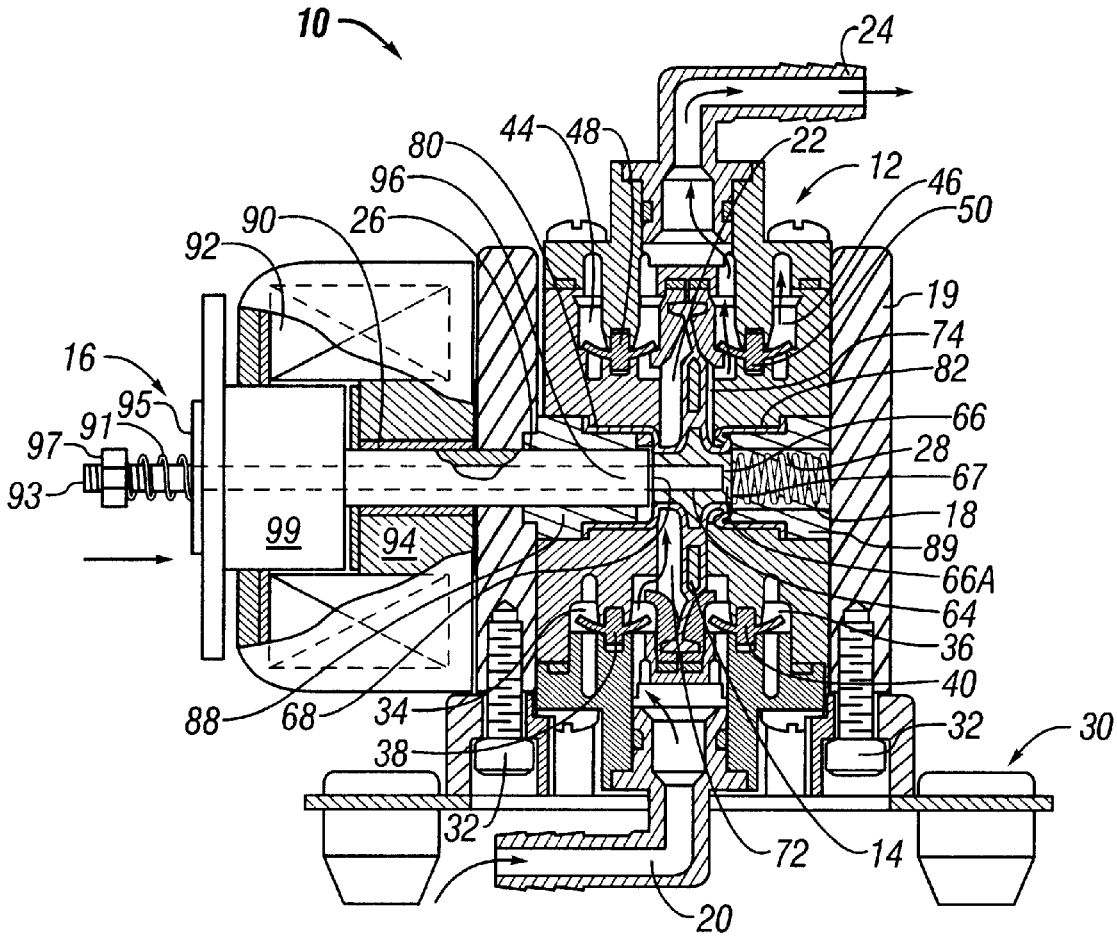
FIG. 1 is an elevational view, partly in cross section, of a pump in accordance with the present invention showing the diaphragm in its rightmost position.

Referring now to FIG. 1, a pump in accordance with the present invention (indicated generally at 10) includes a housing 12, a diaphragm 14 secured within the housing, an electromagnetic assembly in the form of a solenoid 16, and a spring 18. The housing 12 includes an inlet port 20, a chamber 22, and an outlet port 24. The housing 12 in the illustrated preferred embodiment also includes at first aperture 26 and a second aperture 28. If desired, the pump 10 can be mounted to a pump stand 30, such as by connecting the housing 12 to the pump stand 30 using fasteners 32. The pump stand 30 can permit the pump 10 to be secured to other objects as required.

The housing 12 can be fabricated from any suitable material, including without limitation steel, iron, aluminum, and other metals, ceramic, plastic, composite materials, and the like. However, the housing 12 is preferably made at least partially of non-magnetic materials. In some highly preferred embodiments, polymeric materials are used for fabrication of the housing 12.

The housing 12 preferably has (and more preferably defines) a first inlet valve chamber 34 and a second inlet valve chamber 36. Preferably, a first inlet valve element 38 is positioned in the first valve chamber 34 and a second inlet valve element 40 is positioned in the second inlet valve chamber 36. The first and second inlet valve elements 38, 40 are preferably "one-way" valves configured to allow fluid to pass from the inlet port 20, through the first and second inlet valve chambers 34, 36, and into the chamber 22, while preventing fluid from passing from the chamber 22, through the first and second inlet valve chambers 34, 36, to the inlet port 20. In this respect, the first and second inlet valve elements 38, 40 (illustrated as flapper valve elements) are inlet check valves for the pump 10.

The housing 12 preferably also has (and more preferably defines) a first outlet valve chamber 44 and a second outlet valve chamber 46. Preferably, a first outlet valve element 48 is positioned in the first valve chamber 44 and a second outlet valve element 50 is positioned in the second outlet valve chamber 46. The first and second outlet valve elements 48, 50 are preferably "one-way" valves configured to allow fluid to pass from the chamber 22, through the first and second outlet valve chambers 44, 46, and into the outlet port 24, while preventing fluid from passing from the outlet port 24, through the first and second outlet valve chambers 44, 46, to the chamber 22. In this respect, the first and second outlet valve elements 48, 50 (illustrated as flapper valve elements) are outlet check valves for the pump 10. Although the illustrated valve elements 38, 40, 48, 50 are flapper valves, any suitable type of one-way or check valve can be employed in the pump 10. Possible check valve types include without limitation ball valves, swing valves, disk valves, dual plate valves and other valve types.

Figure 2:
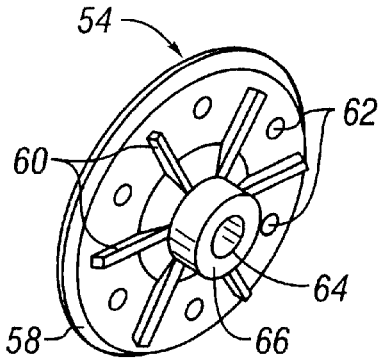
FIG. 2 is a perspective view of a relatively rigid inner element of a diaphragm in accordance with the present invention.
Figure 3:
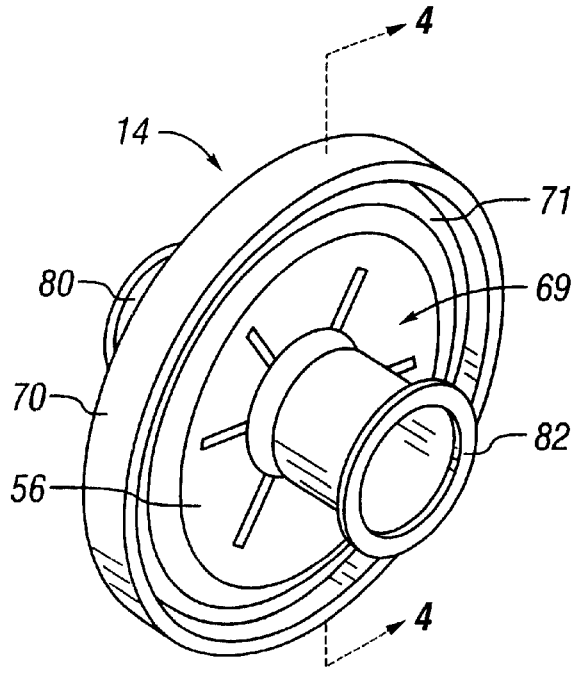
FIG. 3 is a perspective view of a diaphragm in accordance with the present invention.
Figure 4:
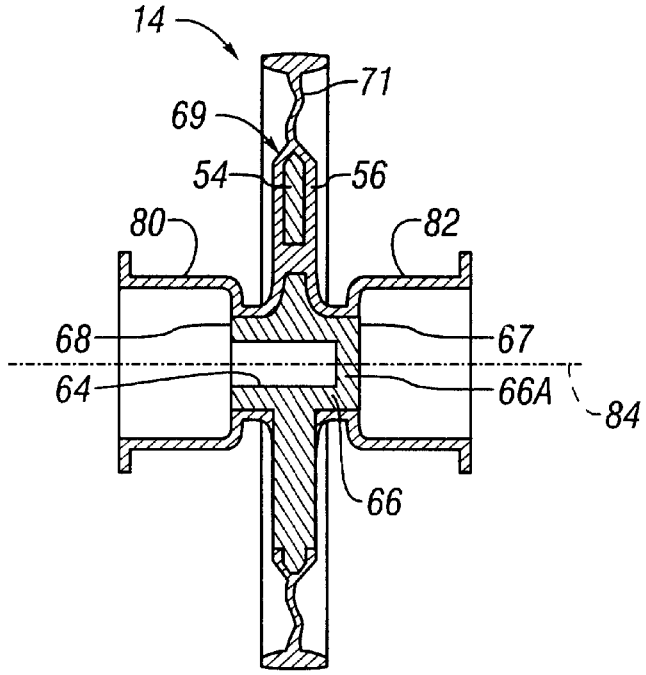
FIG. 4 is a cross-sectional view taken along line 4—4 of FIG. 3.

The diaphragm 14 can be any conventional type of diaphragm for use in a diaphragm pump. However, the pump 10 preferably employs an improved diaphragm of the type illustrated in the figures. In this regard, and with reference to FIGS. 2, 3 and 4, the diaphragm 14 preferably includes a relatively rigid inner portion 54 that is substantially covered by an outer diaphragm portion 56. Both the inner portion 54 and the outer portion 56 are located primarily within the chamber 22. The diaphragm 14 can be made of any suitable material. However in some preferred embodiments of the present invention, the diaphragm 14 is made primarily of polymeric materials. It is highly preferred that the materials used in the construction of the diaphragm (and of the pump 10) not be detrimentally affected by the fluid or fluids being pumped and should likewise not detrimentally affect the fluid or fluids.

The relatively rigid inner portion 54 includes a substantially circular disc 58. Alternatively, the inner portion 54 (and the diaphragm 14) can have any shape desired, preferably dependent at least partially upon the manner in which the diaphragm 14 is secured within the housing 12, the shape of the chamber 22. The inner portion 54 preferably has reinforcing ribs 60 for providing further strength to the inner portion 54. The reinforcing ribs 60 can be arranged and shaped in any manner desired for this purpose, and in some preferred embodiments extend axially outwardly from either side of the disc 58. In other embodiments, such ribs 60 are located on only one side of the disc 58. Preferably, one or more apertures 62 extend through the inner portion 54. For example, multiple apertures 60 can be located between the ribs 60 of the disc 58. Although such apertures 60 are not required, they can provide a strong connection between the inner portion 54 and the outer portion 56 of the diaphragm 14. Specifically, during the manufacture of the diaphragm 14, material used to form the outer diaphragm portion 54 flows or is otherwise positioned in the apertures 62, thereby providing a final diaphragm 14 in which the outer portion 56 is effectively secured to the inner portion 54.

The diaphragm 14 can also have a central opening 64, for purposes that will be described in greater detail below. The central opening 64 can extend fully through the diaphragm 14 or can be a blind hole opening to a side of the diaphragm 14. In some preferred embodiments, a blind hole opens to each side of the diaphragm 14. The central opening 64 can be defined by a central projection 66 having a solid end portion 66A and mutually opposing end surfaces 67 and 68. The inner portion 54 is preferably more rigid with respect to the remainder of the diaphragm 14 and, in particular, with respect to the outer diaphragm portion 56. Preferably, the inner portion 54, and in particular the central projection 66 of the inner portion 54, cooperates with the solenoid 16 and the spring 18 to move the diaphragm 14 in an oscillatory manner within the chamber 22 as is described below.

In some preferred embodiments, of the present invention, the diaphragm 14 includes a central region 69 and an enlarged peripheral region 70 that is configured to be secured to the housing 12 as illustrated in FIG. 1. The central region 69 preferably includes an outer annular region 71 that is relatively flexible to facilitate or allow the desired oscillatory movement of the diaphragm 14 in the chamber 22. The degrees of flexibility and rigidity of the various components of the diaphragm 14 can be varied or changed, as desired, to regulate or otherwise control the particular pumping pressure to be achieved.

When the diaphragm 14 is secured within the chamber 22 and the peripheral portion 70 is secured to the housing 12, the chamber 22 is preferably divided into a first fluid pathway 72 and a second fluid pathway 74 (see FIG. 1). The first and second fluid pathways 72, 74 are substantially fluidly isolated from each other, although a fluid-tight seal between the first and second pathways 72, 74 is not absolutely required (but is highly preferred) for operation of the pump 10. Preferably, the diaphragm 14 is substantially hydraulically balanced, such that there is substantially equal hydraulic pressure on both sides of the diaphragm 14. This "balanced" feature of the diaphragm 14 generally extends the life of the diaphragm 14 and the pump 10.

Some preferred embodiments of the diaphragm 14 have one or more projections 80, 82 preferably extending from a central portion of the diaphragm 14. These projections 80, 82 are employed to create a seal between the fluid chamber 22 and the driving or biasing elements used to control diaphragm position and/or movement. Although the diaphragm 14 of the present invention can have no such projection or can have one projection (extending in a direction toward the driving or biasing element that is to be sealed from the chamber 22), the diaphragm 14 in illustrated preferred embodiment has two such projections 80, 82 by way of example.

The central projections 80 and 82 are preferably formed integrally with the outer diaphragm portion 56, but can be separate elements connected to the diaphragm by adhesive or cohesive bonding material, by screws, rivets, or other conventional fasteners, and the like, or in any other manner. The central projections 80 and 82 preferably surround or substantially surround a central axis 84 of the diaphragm 14 and are configured to be sealingly secured to the housing 12. As shown best in FIG. 1, the central projections 80 are adapted to be snugly received within the first aperture 26 and secured therein by insert 88. A similar insert 89 is used to secure the central projection 82 within the second aperture 28.

The relationship between the projections 80, 82 and the housing 12 as just described, wherein the projections 80, 82 are received within respective apertures 26, 28 of the housing 12, is highly preferred for the ability to effectively seal the chamber 22 from the driving and biasing elements of the pump as described above and in greater detail below. However, it should be noted that either or both projections 80, 82 can be secured Within the housing 12 to seal the driving and biasing elements in other manners. For example, the projections 80, 82 can be clamped to inner walls of the chamber 22 by a clamp ring bolted, screwed, riveted, or secured in any other manner to such walls, can be sealingly secured to the inner walls of the chamber 22 by adhesive or cohesive bonding material, can have one or more gaskets of any type used to create a fluid-tight relationship between each projection 80, 82 and an inner wall of the chamber 22, and the like.

Although the apertures 26, 28 (and inserts 88, 89, if desired) provide a simple and reliable manner of sealing the chamber 22 from other areas of the pump 10 as described above, one having ordinary skill in the art will therefore appreciate that the projections 80, 82 can be secured within the housing 12 to provide such a seal for the chamber 22 in a number of other manners, each one of which falls within the spirit and scope of the present invention. In this regard, it should therefore be noted that each of the embodiments of the present invention described herein and illustrated in the figures can have only one aperture 26, 28 or can have no such apertures as described above. If one or both apertures 26, 28 are employed (e.g., such as for passage of a plunger 90 or for receiving a biasing element 28 as described in greater detail below), the projections 26, 28 need not necessarily extend into such aperture(s) 26, 28.

With continued reference to the illustrated preferred embodiment of FIGS. 1–4, the projections 80 and 82 are preferably secured to the housing 12 to effectively fluidly isolate the chamber 22 from the first aperture 26 and the second aperture 28 of the housing 12. Thus, fluid within the chamber 22 cannot pass into the first aperture 26 and the second aperture 28, and lubricants such as grease or oil are not allowed to pass into the chamber 22 from the apertures 26, 28. This feature allows comestible fluids to be pumped through the chamber 22 because the fluid will not be contaminated by lubricants such as oil or grease that may be present in the first and second apertures 26, 28. Also, a pump 10 having such an arrangement is more durable because the various mechanical components (e.g. the solenoid 16 and the spring 18) do not rely upon the fluid being pumped for lubrication. As such, better lubricants can be used for these parts, and the pump 10 will incur less damage in the event that the pump 10 is operated while no fluid is passing therethrough, a situation commonly referred to as "running dry."

Again with reference to FIG. 1, the solenoid assembly 16 preferably includes a movable plunger 90 positioned in the first aperture 26. The plunger 90 moves axially within the first aperture 26 in response to the operation of a series of electric coils 92 and a magnetic core 94. Energizing the coils 92 with electricity creates a magnetic field that then displaces the plunger 90 in an axial direction. Preferably, the plunger 90 is biased toward the diaphragm 14 so that the plunger 90 is in substantially continuous contact with the diaphragm 14. In those diaphragm embodiments having a central projection 66 as described above, the plunger 90 is preferably biased toward and in continuous contact with the end surface of the central projection 66. However, the plunger 90 can be biased into contact with any other preferably central element or feature of the diaphragm 14 as desired.

In some preferred embodiments of the present invention, the diaphragm 14 and plunger 90 are biased into contact by a spring 91 surrounding a threaded rod 93 and captured between an outer end 95 of the plunger 90 and an adjusting nut 97 threaded onto the threaded rod 93. The threaded rod 93 can extend through the plunger 90 to threadedly engage the central opening 64 of the diaphragm 14. The amount of biasing force applied to maintain contact between the diaphragm 14 and plunger 90 can preferably be adjusted by moving the nut 97 axially along the threaded rod 93.

Continuous contact between the plunger 90 and the diaphragm 14 is highly preferred for superior control and movement of the diaphragm 14. However, it should be noted that such constant contact is not required to practice the present invention. In some embodiments, a gap can exist between the plunger 90 and diaphragm 14 at some points in the movement of the plunger 90 and diaphragm 14. In this regard, it should also be noted that a biasing force placed upon the diaphragm 14 and upon the plunger 90 is not required in all embodiments of the present invention, and is only preferred for more efficient and smooth operation of the pump 10 and to provide improved control over the diaphragm 14.

In those embodiments in which a threaded rod and spring, assembly as described above and illustrated in the figures is employed to bias the diaphragm 14 and plunger 90 together, the rod 93 can be connected to the diaphragm in a number of different manners, such as by being threaded into a central aperture 68 as illustrated in FIG. 1, by a snap-fit or press-fit connection of the rod 93 into the central aperture 68, by one or more conventional fasteners passed through the diaphragm 14 and into the end of the rod 93 by adhesive or, cohesive bonding material, and the like. Also, the threaded rod and spring assembly need not necessarily be adjustable as described above. Instead, the spring 91 can be retained upon the rod by a flange, lip, collar, clip, pin, or other non-adjustable element on the rod 93.

Movement of the plunger 90 within the first aperture 26 is preferably controlled by a conventional electrical circuit communicating with the electric coils 92 to selectively move the plunger 90 in an axial direction. The electrical circuit energizes the coils 92 such that an end 96 of the plunger 90 drives the diaphragm 14 toward a rightmost position as shown in FIG. 1. Preferably, the end 96 of the plunger 90 drives the end 68 of the central projection 66.

The spring 18 preferably functions to urge the diaphragm 14 toward the left with respect to FIG. 1 (i.e., away from the housing end element 19). The spring 18 is preferably located within the second aperture 28 and is captured between the end element 19 of the housing 12 and the diaphragm 14. Depending at least in part upon the shape of the housing and the chamber 22 therein, the spring 18 need not necessarily be located within an aperture 28 as just described and as shown in FIG. 1, and can instead be positioned within the housing 12 in other manners in which the spring 18 is still located between and in biasing relationship with the housing 12 and the diaphragm 14.

Preferably, the spring 18 is positioned against a central portion of the diaphragm 14 (such as the central projection 66 of the diaphragm 14 illustrated in FIG. 1), and can abut a face of the diaphragm 14 such as the solid end 66A of the diaphragm 14 in FIG. 1, can be received within an aperture in the diaphragm 14, or can receive a projection or otherwise be placed around a part of the diaphragm 14.

The biasing force and cooperation of the springs 18, 91 preferably provides a semi-rigid connection between the diaphragm 14, the plunger 90, and the spring 18, in which the diaphragm 14 is compressively held between the plunger 90 and the spring 18. This connection is preferred because forces applied to the diaphragm 14 in a given area (e.g. the end surfaces 67, 68) are substantially always compressive. Various other pump configurations result in forces applied to one area of the diaphragm that are both compressive and tensile in nature, resulting in reduced durability of the diaphragm and consequently the pump. In addition, the above-described relationship between the diaphragm 14, spring 18, and plunger 90 is tolerant to minor imbalances in the operation of the pump 10 due to variations in pump intake or outlet conditions. By way of example only, the diaphragm can be allowed to "flutter" slightly without incurring significant damage (compared to other pumps that have the plunger and other driving mechanisms rigidly connected to the diaphragm).

Referring specifically to FIG. 1, as previously described, energizing the electric coils 92 drives the plunger 90 toward the right in FIG. 1. As the plunger 90 moves, the diaphragm 14 also moves and compresses the spring 18. As the diaphragm 14 moves through the chamber 22, fluid in the second fluid pathway 74 (e.g. to the right of the diaphragm 14) is pumped from the chamber 22, past the outlet valve element 50 through the second outlet valve chamber 46, and to the outlet port 24. As previously described, the second inlet valve element 40 prevents the fluid in the second fluid pathway 74 from exiting the chamber 22 via the inlet port 20. Simultaneously while fluid is being pumped from the second fluid pathway 74, fluid is drawn into the first fluid pathway 72 from the inlet port 20. Fluid flows from the inlet port 20, into the first valve chamber 34 and past the first inlet valve element 38, into the first fluid pathway 72. As previously described, the first outlet valve element 48 prevents fluid from passing from the outlet port 24 into the first fluid pathway 72 via the first outlet valve chamber 44.

When the electric coils 92 are not energized, the biasing force of the spring 18 forces the diaphragm 14 toward the left of the chamber 22 in FIG. 1. This movement results in an opposite situation to that posed above such that fluid is pumped out of the first fluid pathway 72, through the first outlet valve chamber 44 to the outlet port 24. Simultaneously, fluid from the second inlet valve chamber 36 passes into the second fluid pathway 74 where it can then be pumped to the outlet port 24 by a subsequent movement of the diaphragm 14 to the right in FIG. 1. As described above with respect to the first outlet valve element 48 and the second inlet valve element 40, the first inlet valve element 38 and the second outlet valve element 50 substantially prevent fluid from flowing from the chamber 22 to the inlet port 20 and from the outlet port 24 to the chamber 22, respectively. The electric coils 92 are preferably switched on and off such that the diaphragm 14 is rapidly moved to the right by the plunger 90 and subsequently to the left by the spring 18 in an oscillatory manner such that fluid is continually pumped from the inlet port 20 to the outlet port 24.

The diaphragm 14 in the various embodiments of the present invention described herein and illustrated in the figures is preferably biased by a biasing assembly (e.g., spring 18) in a direction counter to the force exerted by the electromagnetic assembly 16. However, in some alternative embodiments, no such biasing assembly exists. In such embodiments, the diaphragm 14 can be biased or otherwise forced in a direction toward the electromagnetic assembly 16 in a number of different manners. For example, the diaphragm 14 can be moved to the left in FIG. 1 by retraction of the plunger 20 and resulting retraction of the rod 93 to which the diaphragm 14 is connected. In such a case, the plunger 90 can be retracted by the electromagnetic assembly 16 in any well-known manner, such as by changing the manner in which the coils 92 are energized. As another example, and as described in greater detail below, the diaphragm 14 can be shaped to be inherently biased in a direction toward the electromagnetic assembly 16. Therefore, de-energization of the electromagnetic assembly 16 permits the diaphragm 14 to return to its natural state. In other embodiments, the rod 93 and/or plunger 90 can be biased to the left (with reference to FIG. 1) by any biasing element, such as a spring, one or more magnets, and the like, connected to the rod 93 or plunger 90 in any manner. By way of example only, a coil spring located around the rod 93 or plunger 90 can have one end connected to the rod 93 or plunger 90 and another end pressed against a part of the pump housing 12. Therefore, movement of the rod 93 or plunger 90 to the right in FIG. 1 causes compression of the coil spring and thereby generates a returning biasing force upon the rod 93 or plunger 90.

As another example, the electromagnetic assembly 16 can have another set of coils through which the rod 93 and plunger 90 pass. This second electromagnetic assembly 16 can be energized to pull the plunger 90 in an opposite direction to the force exerted upon the plunger 90 by the coils 92. Biasing force upon the plunger 90 (and therefore upon the diaphragm 14) in either direction can therefore be exerted and controlled by controlling the energy supplied to the coils by a conventional controller or in any other manner.

Therefore, one having ordinary skill in the art will appreciate that the spring 18, though preferred, is not required in a number of embodiments of the present invention. Also, the alternative manners described above of biasing the diaphragm 14 back toward the electromagnetic assembly 16 can be employed in addition to the use of a spring 18, if desired. Furthermore, any of the manners of biasing the diaphragm 14 back toward the electromagnetic assembly 16 as described above can also or instead be employed to bias the diaphragm 14 in the same direction as the force exerted by the electromagnetic assembly 16 (i.e., to the right in FIG. 1), if desired.

The electromagnetic assembly 16 described above and illustrated in the figures operates to push the diaphragm 14 in order to pump fluid from the second fluid pathway 74 and to draw fluid into the first fluid pathway 72. While this configuration is preferred, it will be appreciated that the electromagnetic assembly 16 can instead be employed to pull the diaphragm 14 when the electromagnetic assembly 16 is energized and to permit the diaphragm 14 to move in an opposite direction (under force from an extension spring or other biasing element as described above) when the electromagnetic assembly 16 is not energized. It is therefore contemplated in the present invention to employ the electromagnetic assembly 16 and a biasing assembly 18 in the reverse manner discussed above, as well as to do so in any of the other embodiments of the present invention described herein.

The pump 10 in the illustrated preferred embodiment employs two springs 91, 18 as described above to bias the plunger 90 and diaphragm 14 together and to bias the diaphragm 14 toward the electromagnetic assembly 16. The springs 91, 18 are illustrated as coil springs, but can instead take any other form capable of providing the biasing force described with reference to the springs 91, 18. Types of such springs or biasing members include leaf springs, Belville springs, torsion springs, and any other type of conventional springs, magnet pairs located to bias elements apart or to bias elements together, elastic straps, blocks, pegs, or other members, and the like, each of which can be positioned and connected as needed to exert the desired biasing force upon diaphragm 14 (either directly or indirectly by exerting such force upon the plunger 90). As used herein and in the appended claims, the term "spring" encompasses all such elements used for exerting a biasing force.

Although an electromagnetic assembly (e.g., a solenoid or similar device) is preferably employed in the pump 10 of the present invention and in the other pump embodiments described herein to drive the diaphragm 14, one having ordinary skill in the art will appreciate that a number of other driving elements and devices can instead be employed as desired. By way of example only, the diaphragm 14 can be actuated by a hydraulic or pneumatic piston, a motor (driving the diaphragm 14 through, for example, a cam connected to the motor and contacting the diaphragm or plunger), an electromagnet set connected to the diaphragm 14 or plunger 90 and to another surface adjacent to the diaphragm 14 or plunger 90, and the like. Still other driving devices and actuators are possible, each one of which can be controlled with the electronic circuitry described in greater detail below to drive the diaphragm 14 and to pump fluid through the pump 10. Such driving devices and actuators can be connected directly to the diaphragm 14 to move the diaphragm 14 or can drive the diaphragm 14 through a piston 90 or other element.

As described in greater detail above, the pump 10 illustrated in FIG. 1 has two inlet valve chambers 34, 36, two outlet valve chambers 44, 46, two inlet valve elements 38, 40, and two outlet valve elements 48, 50. These elements of the pump 10 permit fluid to be pumped to and from the chamber 22 each time the diaphragm moves across the chamber 22. In other embodiments however, the pump 10 has only one inlet valve chamber 34, 36 (and corresponding valve element 38, 40) and/or has only one outlet valve chamber 44, 46 (and corresponding valve element 48, 50). In such embodiments, fluid can be pumped with every other movement of the diaphragm 14 across the chamber 22.

As described above, the pump 10 illustrated in FIG. 1 operates by the rapid oscillatory movement of the diaphragm 14 along with the plunger 90 and the spring 18. In some embodiments, the inventors have discovered that superior pumping results are achieved when the frequency of the movement of the diaphragm 14 is in the range of about 5 Hz to about 50 Hz. More preferably, this frequency is in the range of about 12 Hz to about 30 Hz. Most preferably, the diaphragm pumping frequency is about 10 Hz. In some preferred embodiments, the axial distance of travel of the plunger 90 can vary over a range of, for example, about 0.01 inches or less to about 0.2 inches or more.

As previously mentioned, movement of the plunger 90, and more generally the operation of the electromagnetic assembly 16, is powered and controlled by conventional electronic circuitry. Since only a single electromagnetic assembly is employed in the pump embodiment illustrated in FIG. 1, the electronic circuitry employed to power and control the assembly 16 is less complex than that needed to power and control previous pumps that used two electromagnetic assemblies or solenoids. A relatively simple on/off electrical circuit can be employed to suitably control the pump of the present invention. In addition, by varying the on/off frequency of the electrical circuit, the frequency of the electromagnetic assembly 16, and therefore the relative amount of pumping force provided by the pump 10, can be varied to address the needs of a particular application. On/off electronic circuitry can also be used to control an electromagnetic duty cycle. In some embodiments, a duty cycle of about 50% is preferred. The combination of the single electromagnetic assembly 16 and the spring 18 provides the desired movement of the diaphragm 14 so that the diaphragm 14 is capable of pumping fluid during both directions of movement (e.g. to the left and to the right with respect to FIG. 1). In addition, by employing a single electromagnetic assembly rather than two electromagnetic assemblies, the pump 10 of the present invention is less expensive to manufacture and can be somewhat reduced in size.

Although the various pump embodiments of the present invention described herein and illustrated in the figures each have a single electromagnetic assembly used to drive the diaphragm, it should be noted that two electromagnetic assemblies can instead be used if desired. In such embodiments, the electromagnetic assemblies can be located on the same side of the diaphragm for driving a common plunger as described above, or can be located on opposite sides of the diaphragm (in which case the second electromagnetic assembly can be similar to and operate in a similar manner to the electromagnetic assembly 16 described above).

An additional preferred feature of the pump 10 illustrated in FIG. 1 relates to the presence of a magnetic insulator 98 between the magnetic core 94 and an enlarged end 99 of the plunger 90. In some preferred embodiments, the plunger 90 is preferably configured such that the enlarged end 99 does not contact the core 94. This configuration advantageously avoids a full or complete magnetic circuit between the plunger 90 and the core 94 which would result if the plunger 90 and the core 94 were to come into direct contact. A complete magnetic circuit of this type would require additional force to break relative to the magnetic relationship between the core 94 and the plunger 90 when they are not allowed to contact each other. Also, repeated contact between the enlarged end 99 and the core 94 would create a substantial amount of undesirable noise.

In some embodiments, the electromagnetic assembly 16, the plunger 90, the diaphragm 14 and the housing 12 are designed, e.g., sized and/or positioned and/or configured, to maintain a gap or space between the enlarged end 99 of the plunger 90 and the core 94. For example, the plunger 90 can be sized so that as the plunger 90 moves the diaphragm 14 to its rightmost position (with reference to FIG. 1) the housing 12, the diaphragm 14, and/or the fluid remaining in the chamber 22 prevent the plunger 90 from moving further towards the right, thereby preventing the plunger 90 from contacting the core 94. This feature is highly effectively at substantially reducing or eliminating noise that is often associated with existing pumps using electromagnetic assemblies. The plunger 90 can be prevented from contacting the core 94 by the magnetic insulator 98 as described above, by any of the other manners just described, by one or more stops extending from the housing 12, from the plunger 90, or from the electromagnetic assembly 16, or by a combination of such features.

The magnetic insulator 98 can be provided such that in the event the enlarged end 99 moves beyond the limits of the gap or space between the magnetic insulator 98 and the core 94, the enlarged end 99 contacts the insulator 98 and not the core 94. The insulator 98 is preferably non-metallic and can be, for example, made of ceramic, composite, rubber, or thermoplastic polymeric material. The insulator 98 preferably not only substantially prevents the formation of a complete magnetic circuit as mentioned above, but can also act as a noise reducer in the event the enlarged end portion 99 comes into contact with the core insulator 98. The size and thickness of the insulator 98 can vary depending upon the overall size of the pump 10 and the dimensions of the core 94, the plunger 90, and the housing 12. In one embodiment, the minimum gap between the enlarged end 99 of the plunger 90 and the core 94 (without the insulator 98 present) is in the range of about 0.05 inches or less. The thickness of the insulator 98 can vary significantly. However, the inventors have found that superior results are achieved by employing an insulator having a thickness of between 0.005 inches to 0.025 inches. Other embodiments of the present invention are operable without the insulator 98 by relying upon other design features of the pump 10 to maintain the air gap as described above.

The pump 10 illustrated in FIG. 1 has been thus far described herein as including a double acting diaphragm wherein fluid is pumped during both directions of travel of the diaphragm 14. However, a single acting diaphragm and pump can be provided such that, with regard to FIG. 1, one of the inlet and/or outlet valve structures are not present. In one such embodiment for example, the second inlet valve structure (the chamber 36 and element 40) and the second outlet valve structure (the chamber 46 and element 50) are not present. In this embodiment, the only fluid passageway for the fluid through the pump 10 is from the inlet port 20 across the first inlet valve element 38 into the chamber 22, across the first outlet valve element 48 and then to the outlet port 24. In such a "single action" configuration, the fluid to be pumped enters the chamber 22 with the diaphragm 14 located at its rightmost position in the chamber 22 as shown in FIG. 1. As the diaphragm 14 is moved to its leftmost position, fluid from the chamber 22 passes across the first outlet valve element 48 and into the outlet port 24. With the diaphragm 14 located in the leftmost position, the first inlet valve element 38 is closed, preventing fluid from the chamber 22 from passing back across the inlet valve element 38.

Figure 5:
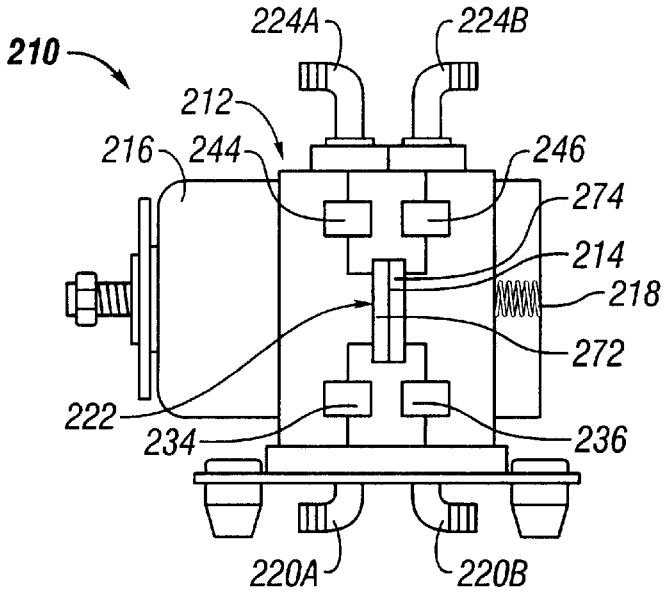
FIG. 5 is a schematic illustration of an alternate pump in accordance with the present invention.

An alternate pump in accordance with the present invention is shown in FIG. 5 at 210. With the exceptions described below, the alternate pump 210 is preferably similar to the pump 10 described above and illustrated in FIGS. 1–4 and operates in a manner similar to the pump 10. In addition, the alternative features, elements, and structure described above with reference to the pump 10 and its components apply equally to the pump 210. Components of the pump 210 that correspond to components of the pump 10 illustrated in FIGS. 1–4 are indicated by the same reference numeral in the 200 series.

A significant difference between the pump 210 illustrated in FIG. 5 and the pump 10 illustrated in FIGS. 1–4 relates to the fact that the pump 210 is structured to pump two different fluids at the same time, or can pump the same fluid through two different pump inlets and/or outlets. In general, the pump 210 substantially comprises two single acting pumps (described above) mated to each other such that they share a common diaphragm. More specifically, a first inlet port 220A fluidly communicates with a first outlet port 224A; and a second inlet port 220B fluidly communicates with a second outlet port 224B. The housing 212 and diaphragm 214 of the pump 210 are preferably configured such that the first fluid pathway 272 between the first inlet port 220A and the first outlet port 224A is fluidly isolated from the second fluid pathway 274.

The pump 210 preferably includes a first inlet valve assembly 234 located between the first inlet port 220A and the first fluid pathway 272. Similarly, a first outlet valve assembly 244 is preferably located between the first fluid pathway 272 and the first outlet port 224A. A second inlet valve assembly 236 is preferably located between the second inlet port 220B and the second fluid pathway 274; and a second outlet valve assembly 246 is preferably located between the second fluid pathway 274 and the second outlet port 224B.

Preferably, the diaphragm 214 is secured to the housing 212 and is structured similarly to the diaphragm 14 of the pump 10, thereby dividing the chamber 222 into the two independent fluid pathways 272 and 274. The solenoid assembly 216 and the spring 218 move the diaphragm 214 between its rightmost position in the chamber 222 and its leftmost position in the chamber 222, in a substantially similar manner as described above with regard to the pump 10. As the diaphragm 214 moves to the right in FIG. 5, a first fluid is drawn from the first inlet port 220A, through the first inlet valve assembly 234, and into the first fluid pathway 272 of the chamber 222. As the diaphragm then moves to the left, the first fluid is preferably expelled from the chamber 222 through the first outlet valve assembly 244 and out of the pump 210 through first outlet port 224A.

Simultaneously while the diaphragm 214 is moving to the left, a second, possibly entirely different, fluid is drawn from the second inlet port 220B, through the second inlet valve assembly 236, and into the second fluid pathway 274 of the chamber 222. As the diaphragm then subsequently moves to the right, the second fluid is preferably expelled from the chamber 222 through the second outlet valve assembly 246, and out of the pump 210 through the second outlet port 224B. The diaphragm 214 can continue to oscillate in this manner to pump the first fluid from the first inlet port 220A, through the first fluid pathway 272, and out the first outlet port 224A, and to pump the second fluid from the second inlet port 220B, through the second fluid pathway 274, and out the second outlet port 224B.

Figure 6:
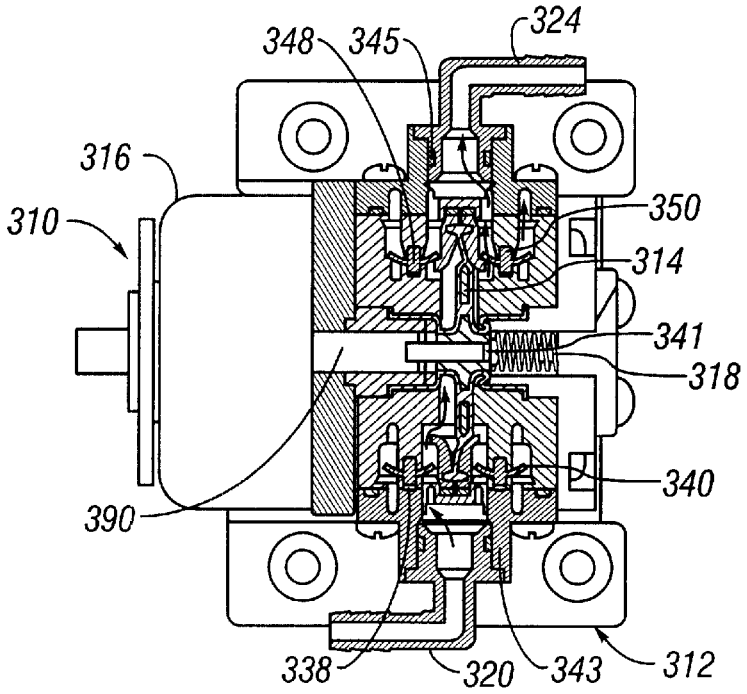
FIG. 6 is an elevational view, partly in cross section, of an alternate embodiment of a pump in accordance with the present invention.

Referring now to FIG. 6, another pump according to the present invention is indicated generally at 310. With the exceptions described below, the alternate pump 310 is preferably similar to the pump 10 described above and illustrated in FIGS. 1–4 and operates in a manner similar to the pump 10. In addition, the alternative features, elements, and structure described above with reference to the pump 10 and its components apply equally to the pump 310. Components of the pump 310 that correspond to components of the pump 10 illustrated in FIGS. 1–4 are indicated by the same reference numeral in the 300 series.

A significant difference between the pump 310 illustrated in FIG. 6 and the pump 10 illustrated in FIGS. 1–4 relates to the presence of a bias diaphragm 314 (described in detail below). Specifically, the diaphragm 314 in the pump illustrated in FIG. 6 is preferably biased toward one side of the chamber 322, whereas this is not necessarily the case in the pump 10 illustrated in FIGS. 1–4.

In addition, unlike the pump 10 illustrated in FIGS. 1–4, the pump 310 illustrated in FIG. 6 does not employ a rod passing through the plunger 390 and connected to the diaphragm 314. Instead, the plunger 390 in the pump 310 illustrated in FIG. 6 is connected to the diaphragm 314. This connection can take any of the forms described above with reference to the connection between the rod 93 and the diaphragm 90 in the pump 10 illustrated in FIGS. 1–4. Preferably however, the plunger 390 is connected to the diaphragm 314 with a threaded fastener (e.g., screw 341 as shown in FIG. 6). The first and second inlet valve elements 338, 340, and the first and second outlet valve elements 348, 350 illustrated in FIG. 6 preferably serve substantially the same function and are substantially similar in construction to the corresponding components of the pump 10 in FIGS. 1–4. The valve elements 338, 340, 348, and 350 of the pump 310 can similarly include the various types and specific constructions discussed above with respect to the valve elements 38, 40, 48, and 50 of the pump 10 illustrated in FIGS. 1–4.

The pump 310 preferably includes an inlet port 320 that is rotatable relative to the housing 312 as well as an outlet port 324 that is also rotatable relative to the housing 312. The rotatability of the ports 320, 324 provides additional flexibility with respect to the placement and installation of the pump 310 for a given application. The rotatability of the inlet port 320 and outlet port 324 is achieved by providing O-ring seals 343 and 345 surrounding the inlet port 320 and the outlet port 324, respectively, and engaging corresponding inner walls of the housing 312. The O-rings substantially prevent leakage of fluid from the pump 310 while providing the ability to rotate the inlet and outlet ports 320, 324 with respect to the housing 312. Alternatives to O-ring seals can instead be employed, including labyrinth seals, gaskets, and other types of seals. Although both ports 320, 324 are rotatable in pump 310 illustrated in FIG. 6, the pump 310 can instead have only one rotatable port 320, 324, if desired. Rotatable ports such as those illustrated in FIG. 6 can be employed in any of the pump embodiments discussed herein.

Figure 7:
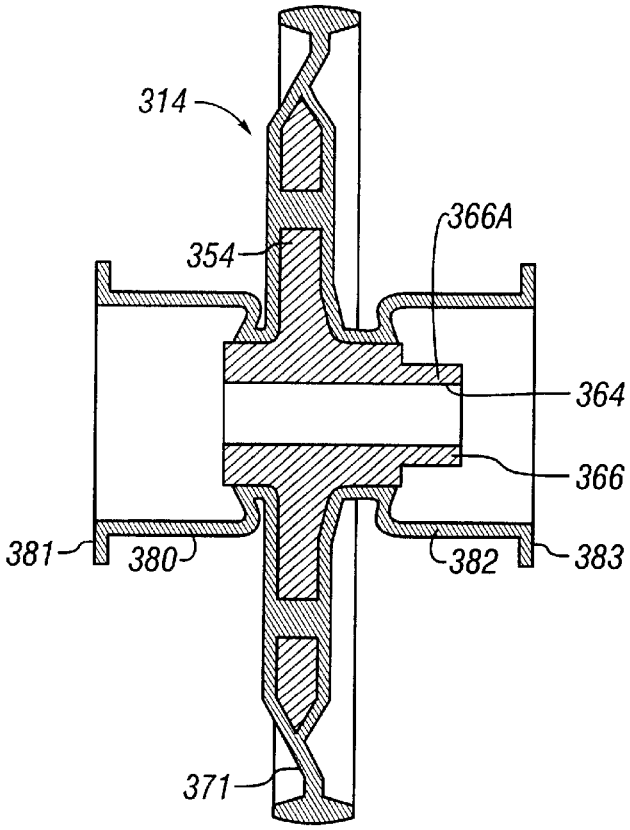
FIG. 7 is a cross-sectional view of a bias diaphragm in accordance with the present invention.

Referring now to FIG. 7, the bias diaphragm 314, is illustrated. The bias diaphragm 314 is preferably substantially the same in structure and operation to the diaphragm 10 in the first illustrated embodiment described above, with the exception of the features which will now be described. Components of the diaphragm 314 that correspond to components of the diaphragm 14 in the first illustrated preferred embodiment are identified by the same reference numeral in the 300 series.

A significant difference between the bias diaphragm 314 illustrated in FIGS. 6 and 7 and the diaphragm 14 in the first preferred embodiment described above relates to the biased nature of the diaphragm 314. Specifically, the radially extending inner portion 354 of the diaphragm 314 is preferably axially offset with respect to the outer annular region 371 when the diaphragm 314 is free from external forces (or at least when the pump 310 in which the diaphragm 314 is installed is not operating). As shown in FIG. 7, the inner portion 354 is biased, for example, to the left. In those embodiments of the diaphragm 314 in which the outer annular region 371 is substantially centrally located between the projections 380, 382, the inner portion 354 is preferably positioned closer to one projection 380 than to the other 382 when free from external forces (or at least when the pump 310 in which the diaphragm 314 is installed is not operating). Preferably, the bias diaphragm 314 is installed in the pump 310 such that the bias diaphragm 314 is biased toward the plunger 390, although the bias diaphragm 314 can be installed in an opposite orientation in other embodiments of the present invention.

The bias diaphragm 314 can be manufactured using the same methods and materials and can have any of the various features and structures as described previously with regard to the diaphragm 14 in the first preferred embodiment above, with the understanding that the resultant product is to be biased as illustrated in FIG. 7 and described above.

The bias diaphragm 314 is preferably configured to bias the diaphragm 314 in a particular direction within the pump 310. Although this direction can be toward or away from the plunger 390 as desired, the bias diaphragm 314 is preferably biased in the opposite direction of the force exerted upon the diaphragm 314 by the electromagnetic assembly 316. In the illustrated preferred embodiment of FIGS. 6 and 7, the bias diaphragm 314 assists the spring 318 in moving the diaphragm 314 in the opposite direction of the plunger 390 (e.g. to the left in FIG. 6). The assistance provided to the spring 318 by the bias diaphragm 314 can enhance the return force of the spring 318, thereby increasing pump capacity.

An additional distinction between the bias diaphragm 314 in the pump embodiment illustrated in FIGS. 6 and 7 and the diaphragm 14 in the first preferred embodiment above is the presence of the through opening 364 formed in the central projection 366 as opposed to the blind opening 64 of the diaphragm 14 in the first preferred embodiment. The through opening 364 of the bias diaphragm 314 allows a screw 341 or other conventional fastener to be extended therethrough and engaged with the plunger 390 (e.g., threadedly engaged with the plunger 390 in the case of a screw 341 or other threaded fastener), thereby securing the diaphragm 314 between the screw 341 and plunger 390. Also, the central projection 366 is preferably elongated toward the distal end 383 of second projection 382. Specifically, a portion 366A of the central projection 366 extends into the cavity surrounded by the second projection 382 and has a reduced diameter relative to the central projection 366. The reduced diameter of the portion 366A is received within the coils of the spring 318 as shown in FIG. 6. This central projection structure and relationship with the spring 318 is one example of many that can be employed (as is discussed in greater detail above with reference to the first preferred embodiment of the present invention).

Figure 8:
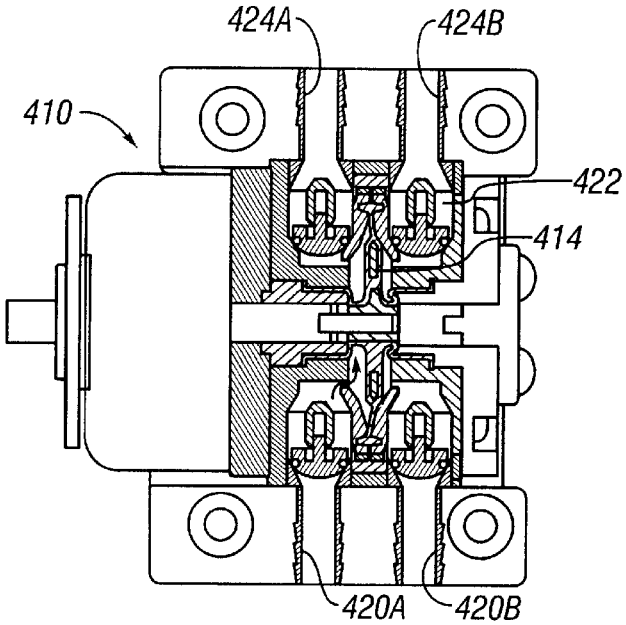
FIG. 8 is an elevational view, partly in cross section of an additional embodiment of a pump in accordance with the present invention.

Another embodiment of a pump according to the present invention is illustrated in FIG. 8, and is indicated generally at 410. The pump 410 is preferably structured and functions similarly to the pump 310 illustrated in FIGS. 6 and 7, and preferably includes a bias diaphragm 414 that is substantially similar to the bias diaphragm 314 described above. Components of the pump 410 that correspond to components of the pump 310 illustrated in FIGS. 6 and 7 are indicated by the same reference numeral in the 400 series.

A significant difference between the pump 410 illustrated in FIG. 8 and the pump 310 illustrated in FIGS. 6 and 7 relates to the ability of the pump 410 to pump two different fluids at the same time. As such, the differences between the pump 410 and the pump 310 are substantially similar to the differences between the pump 10 and the pump 210 described above. The pump 410 preferably includes two inlet ports 420A, 420B and two outlet ports 424A, 424B, fluidly communicating with the chamber 422 in a substantially similar manner as the inlet ports 220A, 220B and outlet ports 224A, 224B of the pump 210 described above. As such, the pump 410 is capable of pumping two different fluids at the same time.

An additional feature of the pump 410 illustrated in FIG. 8 is that the inlet ports 420A, 420B and the outlet ports 424A, 424B are configured to be substantially stationary and connectable to rigid or flexible tubing, as desired. It should be understood that such ports can be employed in any of the other pump embodiments described herein.

Figure 9:
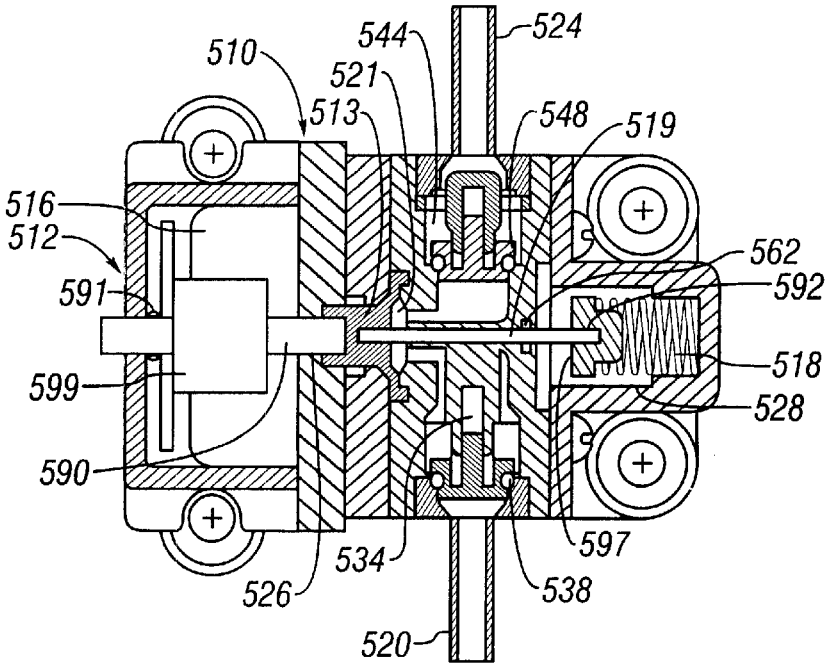
FIG. 9 is an elevational view, partly in cross section, of a further pump in accordance with the present invention.

Yet another embodiment of a pump according to the present invention is illustrated in FIG. 9, and is indicated generally at 510. The pump 510 preferably includes a housing 512, a diaphragm 513, an electromagnetic assembly or solenoid 516 (or other driving device as described above with reference to the first preferred embodiment), a spring 518 and an elongated rod 519. The housing 512 includes an inlet port 520 and an outlet port 524, and can also include a first aperture 526 and a second aperture 528 as described in greater detail above with reference to the first preferred embodiment. Components of the pump 510 that are similar to components of the pump 10 described with reference to the first preferred embodiment above are identified by the same reference numeral in the 500 series.

A significant difference between the pump 510 illustrated in FIG. 9 and the pump 10 of the first preferred embodiment described above is that the pump 510 is single acting. As such, during oscillatory movement of the diaphragm 513, fluid is expelled from the outlet port 524 only when the diaphragm moves in one axial direction (e.g. to the right in FIG. 9), whereas the diaphragm 14 of the pump 10 illustrated in FIG. 1 expels fluid as the diaphragm 14 moves in both axial directions. This characteristic accounts for a number of the component alterations found in the pump 510 compared to the pump 10.

The pump 510 preferably includes an inlet valve chamber 534 housing an inlet valve element 538 and an outlet valve chamber 544 housing an outlet valve element 548. The chambers 534, 544 and elements 538, 548 are preferably configured and operate in substantially the same manner (e.g. as check valves) as the previously described inlet/outlet chambers and elements, and can have any of the alternative structures and can operate in any of the alternative manners also described above with reference to the previous embodiments. A fluid chamber 521 fluidly communicates with both the inlet valve chamber 534 and the outlet valve chamber 544. The fluid chamber 521 of the pump 512 differs from the chamber 22 of pump 10 in that there is preferably only one fluid pathway in the fluid chamber 521 (the one fluid pathway providing fluid communication between the inlet valve chamber 534 and the outlet valve chamber 544). In other embodiments of the present invention, two or more fluid pathways run to and/or from the same chamber 521, but all fluid pathways running from the chamber 521 run to the same pump outlet 524, while all fluid pathways running to the chamber 521 run from the same pump inlet 520.

The diaphragm 513 is preferably secured within the chamber 521 and substantially fluidly seals the chamber 521 from the first aperture 526. Within the first aperture 526, the diaphragm 513 engages or is otherwise in contact with a plunger 590 that is operatively associated with the solenoid 516 in substantially the same manner as the plunger 90 and solenoid 16 of the pump 10. Preferably, the rod 519 opposes the plunger 590, and is connected to the diaphragm 513 in any of the manners described above with reference to the connection between the rod 93 and the diaphragm 14 in the first preferred embodiment described above. The diaphragm 513 preferably extends through an aperture in the housing 512 and engages an aperture 592 formed in an insert 597. The insert 597 engages the spring 518, thereby transferring the biasing force of the spring 518 to the rod 519 to bias the rod 519 against the diaphragm 513. An O-ring 562 can be used to fluidly seal the chamber 521 from the second aperture 528, and preferably surrounds the rod 519 and engages an inner wall of the housing 512 for this purpose. The structure of the diaphragm 513 combined with the O-ring 562 preferably fluidly isolates the chamber 521 from the apertures 526, 528, thereby enabling the pump 510 to pump comestible fluids as described earlier with respect to the pump 10 of the first preferred embodiment.

Although not required for operation of the pump 510, the plunger 590 is biased toward the diaphragm 513 by a spring 591. The spring 591 provides a biasing force similar to the spring 91 of the pump 10 in the first preferred embodiment. Although the spring 591 can be positioned to exert biasing force in a manner similar to that described above with reference to the first preferred embodiment illustrated in FIG. 1, the spring 591 is more preferably positioned within the housing 512 and engages an inner housing wall and an enlarged end 599 of the plunger 590. As such, the spring 591 is surrounded by and enclosed within the housing 512. Such a structure can be employed with any of the other pump embodiments described herein.

The operation of the pump 510 is preferably substantially the same as the operation of the pump 10 described above, with the exception that the pump 510 is single acting as also described above. The solenoid 516 is energized by control circuitry which drives the plunger 590 axially toward the diaphragm 513 (e.g. to the right in FIG. 9) against the biasing force provided by the spring 518. As the diaphragm 513 moves to the right, fluid in the chamber 521 is pumped past the outlet valve element 548, into the outlet valve chamber 544 and out of the pump 510 through the outlet port 524. Simultaneously, the inlet valve element 538 prevents fluid from flowing from the chamber 521 to the inlet port 520. The control circuitry then preferably de-energizes the solenoid 516, and the diaphragm 513 is moved in an opposite axial direction by the biasing force provided by the spring 518 (e.g. to the left in FIG. 9). As the diaphragm moves to the left, fluid is draws from the inlet port 520, past the inlet valve element 538, through the inlet valve chamber 534 and into the chamber 521. Simultaneously, the outlet valve element 548 prevents fluid from flowing from the outlet port 524 to the chamber 521. The diaphragm 513 preferably continues to oscillate in this manner, thereby pumping fluid from the inlet port 520, through the pump 510, to the outlet port 524.

Figure 10:
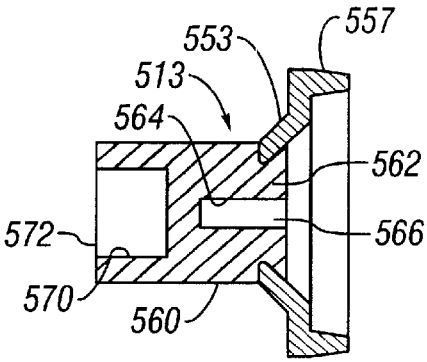
FIG. 10 is a cross sectional view of the diaphragm used in the pump of FIG. 9.

With specific reference to FIG. 10, the diaphragm 513 preferably includes an intermediate annular region 553 surrounded by an enlarged peripheral region 557 configured to be secured to the housing 512 (for example, as illustrated in FIG. 9). The intermediate region 553 preferably has a substantial degree of flexibility to provide the desired moveability of the diaphragm 513 within the chamber 521 of the pump 510.

Although the central portion 560 of the diaphragm 513 can have any shape desired (including those described above with reference to the earlier embodiments), the diaphragm 513 preferably includes an elongated central portion 560 having increased rigidity with respect to the intermediate region 553. The elongated portion 560 is configured such that a forward region 562 is received by and retained within a central opening defined by the intermediate annular region 553. The elongated portion 560 defines a first blind aperture 564 having an open end 566, and a second blind aperture 570 also having an open end 572. As illustrated in FIGS. 9 and 10, the diaphragm 513 is formed in a biased manner toward the intake or suction position of the diaphragm 513. Although the apertures 564, 570 described above are most preferred for purposes of connection to the plunger 590 and the elongated rod 519, both the plunger 590 and rod 519 can be connected to the diaphragm 513 in any other manner described above with reference to the first preferred embodiment of the present invention.

Figure 11:
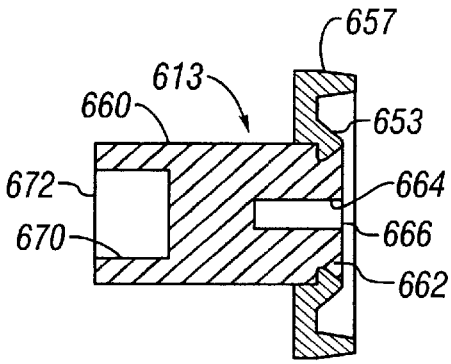
FIG. 11 is a cross sectional view of an alternate diaphragm useful in a pump as illustrated in FIG. 9.

With reference to FIG. 11, an alternate diaphragm is indicated generally at 613. With the exceptions described below, the diaphragm 613 is preferably structured and operates in a similar manner to the diaphragm 513 described above. Components of the alternate diaphragm 613 corresponding to components of the diaphragm 513 are indicated by the same reference numeral in the 600 series.

A significant difference between the diaphragm 613 illustrated in FIG. 11 and the diaphragm 513 illustrated in FIG. 10 relates to the biased shapes of the diaphragms 513, 613. As illustrated in FIG. 10, the diaphragm 513 is biased toward an intake or suction position whereas, as illustrated in FIG. 11, the diaphragm 613 is biased toward a discharge position. The diaphragms 513, 613 are preferably substantially interchangeable with each other such that either diaphragm 513, 613 can be used in a similarly configured pump (e.g. the pump 510), the diaphragms 513, 613 being selected based upon the specific pumping operation to be performed.

Any of the various pumps described above can be single or double acting. If the pump is double acting, it can also be configured to simultaneously pump two different fluids, if desired. The various pumps disclosed herein include diaphragms that fluidly isolate the pumping chamber (through which a fluid can be pumped) from the driving and biasing components of the pump. This advantageous feature prevents contamination of the pumped fluid while also allowing for more effective types of lubrication to be used for the other mechanical components of the pump.

While this invention has been described with respect to various specific examples and embodiments, it is to be understood that the invention is not limited thereto and that it can be variously practiced within the scope of the following claims.

What is claimed is:

1. A pump comprising:

a housing defining an inlet port, an outlet port, a first aperture, a second aperture and a chamber in fluid communication with the inlet port and the outlet port;

a diaphragm secured in the chamber and extending into at least one of the first and second apertures, the diaphragm cooperating with the housing to define a fluid passageway between the inlet port and the outlet port;

an electromagnetic assembly secured to the housing and including a plunger movable within the first aperture, the diaphragm moving in response to movement of the plunger to pump fluid from the inlet port toward the outlet port; and a first spring urging the diaphragm toward the plunger, the diaphragm fluidly isolating the first and second apertures from the chamber.

2. The pump of claim 1 wherein the first spring comprises a compression spring.

3. The pump of claim 1 wherein the diaphragm includes opposing cup portions extending into the first and second apertures.

4. The pump of claim 1 wherein the first spring is at least partially surrounded by the second aperture and engages the housing and the diaphragm.

5. The pump of claim 1 further comprising a second spring biasing the plunger toward the diaphragm.

6. The pump of claim 5 further comprising a spring adjusting member operably engaging the second spring to adjust a biasing force applied to the plunger by the second spring.

7. The pump of claim 1 wherein the movement of the plunger is limited to maintain a gap of separation between the plunger and a core of the electromagnetic assembly.

8. The pump of claim 7 wherein the plunger is sized and positioned to maintain the gap of separation.

9. The pump of claim 1 further comprising an inlet valve assembly positioned generally upstream of the chamber to control fluid flow between the inlet port and the chamber, and an outlet valve assembly positioned generally downstream of the chamber to control fluid flow between the chamber and the outlet port.

10. The pump of claim 9 wherein the inlet valve assembly and the outlet valve assembly each comprises at least one check valve.

11. The pump of claim 1 wherein at least one of the inlet port and the outlet port are rotatable relative to the housing.

12. The pump of claim 1 wherein the housing defines a plurality of inlet ports and a plurality of outlet ports, and the diaphragm and the housing cooperate to define a plurality of mutually independent fluid passageways.

13. The pump of claim 1 wherein the first spring and the electromagnetic assembly are positioned on opposing ends of the housing, and wherein the diaphragm is formed in a biased manner, the diaphragm biased toward one of the electromagnetic assembly and the first spring.

14. The pump of claim 1 wherein the diaphragm is formed to be biased toward the first spring.

15. A diaphragm for use in a pump, the diaphragm comprising:

a central portion having a central axis and adapted for movement relative to a housing of a pump to pump fluid through the housing;

a peripheral portion joined to the central portion and adapted to be secured directly to the housing; and first and second projections extending generally axially outwardly from the central portion, each of the first and second projections including a sealing region adapted to be secured to the housing.

16. The diaphragm of claim 15 wherein the peripheral portion generally circumscribes the central axis.

17. The diaphragm of claim 15 wherein the first and second projections generally circumscribe the central axis and extend axially beyond the peripheral portion.

18. The diaphragm of claim 15 wherein the first and second projections are generally tubular.

19. The diaphragm of claim 15 further comprising a central opening.

20. The diaphragm of claim 15 wherein the diaphragm is made of one or more polymeric materials.

21. The diaphragm of claim 15 wherein the peripheral portion and the first and second projections are flexible to allow relative movement between the central portion and the pump housing, thereby pumping a fluid through the housing.

22. The diaphragm of claim 15 wherein, the central portion is spaced an equal distance from distal ends of the first and second projections when the diaphragm is in a relaxed position.

23. The diaphragm of claim 15 wherein, the central portion is closer to a distal end of the first projection than to a distal end of the second projection when the diaphragm is in a relaxed position.

24. A pump comprising:

a housing defining an inlet port, an outlet port and a chamber in fluid communication with the inlet port and the outlet port;

a diaphragm secured within the chamber and cooperating with the housing to define a fluid passageway between the inlet port and the outlet port, the diaphragm being movable between a discharge position in which fluid in the fluid passageway is discharged to the outlet port and an intake position in which fluid from the inlet port is passed to the fluid passageway, the diaphragm including a central blind aperture opening on a first side of the diaphragm;

a rod slidingly received within the central aperture and being movable between a first position corresponding to the discharge position, and a second position corresponding to the intake position;

an electromagnetic assembly secured to the housing and engaging the rod, the electromagnetic assembly operable to move the rod in a direction of movement toward one of the discharge position and the intake position; and a spring engaging the diaphragm and biasing the diaphragm against the rod, the spring also providing a biasing force substantially opposing the direction of movement of the electromagnetic assembly to move the diaphragm toward the other of the discharge position and the intake position.

25. The pump of claim 24 wherein the diaphragm is formed in a biased manner, the diaphragm biased toward one of the intake position and the discharge position.

26. The pump of claim 24 wherein the movement of the rod is limited to maintain a gap of separation between the rod and a core of the electromagnetic assembly.

27. The pump of claim 24 further comprising a seal fluidly isolating the fluid chamber from the spring.

28. The pump of claim 24 wherein the diaphragm is made of at least one polymeric material.

29. The pump of claim 24 further comprising a second spring biasing the rod toward the diaphragm.

30. The pump of claim 24 further comprising an inlet valve assembly positioned generally upstream of the chamber to control fluid flow between the inlet port and the fluid passageway, and an outlet valve assembly positioned generally downstream of the chamber to control fluid flow between the fluid passageway and the outlet port.

31. A diaphragm assembly for use in a pump, the assembly comprising:

a plunger;

a peripheral region adapted to be secured to a housing of a pump;

an intermediate region joined to the peripheral region and including an insert providing increased rigidity to the central region with respect to the intermediate region, the insert defining a recess adapted to receive said plunger of the pump, and the central region being movable with respect to the housing to pump fluid through the housing.

32. The diaphragm assembly of claim 31 wherein the intermediate region and the insert are made of different materials.

33. The diaphragm of claim 31 wherein the central region extends axially beyond the intermediate region and the peripheral region.

34. The diaphragm assembly of claim 31 wherein the central region includes a first face and an opposing second face, and wherein the insert defines a first blind aperture, formed of the recess and opening toward the first face and a second blind aperture opening toward the second face.

35. The diaphragm of claim 31 further comprising a plane lying substantially within the peripheral portion, wherein the central region is spaced axially away from the plane.

36. The diaphragm of claim 31 further comprising a plane lying substantially within the peripheral portion, wherein the central region extends generally through the plane.

37. A diaphragm pump comprising:

a housing defining an inlet port, and an outlet port;

a driving assembly secured to the housing and including a plunger, the plunger extending into the housing and oscillating in response to operation of the driving assembly;

a diaphragm secured within the housing and engaging the plunger for oscillation therewith, the diaphragm cooperating with the housing to define a first fluid chamber fluidly communicating with the inlet port and the outlet port, a second chamber fluidly isolated from the first fluid chamber, and a plunger chamber surrounding the plunger and fluidly isolated from the first fluid chamber and the second chamber.

38. The diaphragm pump of claim 37, wherein the driving assembly includes an electromagnetic solenoid assembly and a spring.

39. The diaphragm pump of claim 38, wherein the solenoid assembly engages the diaphragm on a first side for movement of the diaphragm in a first direction, and wherein the spring engages the diaphragm on an opposite side for movement of the diaphragm in an opposite direction.

40. The diaphragm pump of claim 37, wherein the diaphragm includes a substantially rigid central portion engaging the plunger, a substantially flexible outer portion surrounding the central portion and engaging the housing, and a substantially flexible cup portion extending away from the central portion and engaging the housing, the cup portion defining a fluid impermeable membrane between the plunger chamber and at least one of the first fluid chamber and the second chamber.

41. The diaphragm pump of claim 40, wherein the cup portion substantially surrounds an end of the plunger.

42. The diaphragm pump of claim 37, further comprising an inlet valve regulating fluid flow between the inlet port and the first fluid chamber, and an outlet valve regulating fluid flow between the first fluid chamber and the outlet port.

43. The diaphragm pump of claim 42, wherein the inlet valve comprises a one-way valve permitting fluid flow from the inlet port to the first fluid chamber and substantially preventing fluid flow from the first fluid chamber to the inlet port.

44. The diaphragm pump of claim 42, wherein the outlet valve comprises a one-way valve permitting fluid flow from the first fluid chamber to the outlet port and substantially preventing fluid flow from the outlet port to the first fluid chamber.

45. A diaphragm for use in a pump, the diaphragm comprising:

a peripheral region adapted to be secured to a housing of a pump;

an intermediate region joined to the peripheral region; and a central region joined to the intermediate region and including an insert providing increased rigidity to the central region with respect to the intermediate region, the insert defining a recess having a substantially smooth inner wall for slidingly receiving a plunger of the pump, and the central region being movable with respect to the housing to pump fluid through the housing.

* * * * *